United States Patent [19]

Argade et al.

[11] 4,182,670

[45] Jan. 8, 1980

[54] COMBINED CATHODE AND DIAPHRAGM UNIT FOR ELECTROLYTIC CELLS

[75] Inventors: Shyam D. Argade, Woodhaven, Mich.; Thomas G. Coker, Natick, Mass.

[73] Assignee: BASF Wyandotte Corporation, Wyandotte, Mich.

[21] Appl. No.: 924,895

[22] Filed: Jul. 17, 1978

Related U.S. Application Data

[60] Continuation-in-part of Ser. No. 694,976, Jun. 11, 1976, abandoned, which is a division of Ser. No. 611,030, Sep. 8, 1975, Pat. No. 4,049,841.

[51] Int. Cl.[2] ..... C25B 11/03; C25B 11/06; C25B 13/04

[52] U.S. Cl. ..... 204/252; 204/290 R; 204/295; 204/296; 204/283

[58] Field of Search ..... 204/252, 290 F, 295, 204/296, 128, 129, 290 R, 283

[56] References Cited

U.S. PATENT DOCUMENTS

| | | | |
|---|---|---|---|
| 3,694,281 | 9/1972 | Leduc | 204/295 UX |
| 3,853,720 | 12/1974 | Korach et al. | 204/295 X |
| 3,928,166 | 12/1975 | O'Leary et al. | 204/296 X |
| 3,945,907 | 3/1976 | Gokhale | 204/290 F |
| 3,980,613 | 9/1976 | Bachot et al. | 204/296 X |

FOREIGN PATENT DOCUMENTS

| | | | |
|---|---|---|---|
| 1299287 | 7/1969 | Fed. Rep. of Germany | 204/128 |
| 62308 | 4/1969 | German Democratic Rep. | 204/129 |
| 51-42082 | 4/1976 | Japan | 204/296 |

*Primary Examiner*—J. H. Mack
*Assistant Examiner*—D. R. Valentine
*Attorney, Agent, or Firm*—Joseph D. Michaels; Bernhard R. Swick

[57] ABSTRACT

An especially efficient and durable electrolytic cell is provided by utilizing a combined cathode and diaphragm unit wherein the cathode is made by spray coating a ferrous metal substrate with a powder metal having lower hydrogen overvoltage than said substrate to form a protected cathode surface having a larger surface area than the substrate, and vacuum depositing a polymer impregnated asbestos fiber diaphragm onto a spray coated surface of the cathode to form a fibrous diaphragm thereon. Preferably, the cathode surface is made with nickel and the polymer impregnated asbestos diaphragm contains from about 10 to about 30 percent based on the weight of asbestos of an organic cementing agent such as a fluorohydrocarbon polymer.

14 Claims, No Drawings

COMBINED CATHODE AND DIAPHRAGM UNIT FOR ELECTROLYTIC CELLS

CROSS-REFERENCE TO RELATED APPLICATIONS

This application contains in part the disclosure of our copending application Ser. No. 694,976 filed June 11, 1976, now abandoned, for "SPRAYED CATHODES," which application is a divisional application of U.S. patent application Ser. No. 611,030, filed Sept. 8, 1975, entitled "SPRAYED CATHODES," now U.S. Pat. No. 4,049,841. The disclosure of this patent is also herein incorporated by reference.

BACKGROUND OF THE INVENTION

1. Field of the Invention

The present invention relates to a combined cathode and diaphragm unit for the electrolytic cells, and more particularly the present invention relates to such units for electrolytic cells utilized for the electrolysis of sodium chloride.

2. Prior Art

Electrolysis cells utilizing asbestos diaphragms have been known for many years, and considerable commercial production has been achieved utilizing same. Although many efforts have been made to eliminate the use of asbestos as a diaphragm material, the fact remains that asbestos has so many advantages that it is still in widespread use. Efforts to improve chlor-alkali cells utilizing asbestos diaphragms have been made for many years, but improvements are still being found and present invention relates to such an improvement.

It has been well known to combine asbestos fibers with other materials such as bonding agents for a variety of purposes. U.S. Pat. No. 3,723,264 teaches a diaphragm for use in electrochemical oxidation of an olefinic compound. The diaphragm comprises an asbestos being bound with a polymeric binder including tetrafluoroethylene. U.S. Pat. No. 3,694,281 also teaches the use of innumerable binders for the impregnation of the asbestos matrix. U.S. Pat. No. 3,704,221 broadly discloses the bonding of asbestos with fluorohydrocarbons. The reference teaches the use of a fibrous mat formed from asbestos or the like and which is reinforced with the bonding agent, which is preferably a fluorocarbon resin. However, the reference does not appear to directly teach the use of fluorocarbon bonding agents for asbestos diaphragms in chlor-alkali cells. Netherlands Pat. No. 740,587 teaches the bonding of asbestos fibers for use in chlor-alkali diaphragms. Included in the bonding materials are fluorocarbon resins along with a variety of other resins. However, the processing for the binding and preparation of the asbestos diaphragm differs from that utilized in the present invention. Accordingly, although considerable prior art is available on the bonding of asbestos, it is believed that the prior art does not teach applicant's polymer impregnated asbestos processed with a special cathode screen to produce the desired improved results in chlor-alkali cells.

As noted above, U.S. Pat. No. 4,049,841 discloses a cathode having special surface characteristics which may be combined with various fiber diaphragms such as asbestos and provide an improvement in lowering the hydrogen overvoltage of the cathode. Similarly, U.S. Pat. Nos. 3,945,907 and 3,974,058 show special cathodes having a low hydrogen overvoltage. However, it is believed that the advantages achieved by the combined cathode and diaphragm unit of this invention are not suggested by any of these prior art patents.

SUMMARY OF THE INVENTION

In accordance with the invention, a cathode and diaphragm unit is provided for electrolytic cells which provides an improved efficiency of operation. First of all, the use of the sprayed cathode provides a reduced hydrogen overvoltage that provides a considerable cost saving in energy. Secondly, the use of the polymer impregnated asbestos allows for the use of a thinner diaphragm with corresponding lower resistance. The polymer impregnated diaphragm during cell operation does not swell and cause the high resistance of a regular asbestos diaphragm. In addition, the combination of the electrode, which has a roughened surface, and the asbestos containing the cementing agent allows for the diaphragm to be separated from the cathode during use with considerably less coverage of asbestos on the cathode than in asbestos diaphragms heretofor used with a resulting better hydrogen generating surface, improvements in the likelihood of disengagement of the diaphragm from the cathode while retaining the physical integrity of the diaphragm, and an overall improved efficiency as a result of the combination.

Thus, the invention provides a chlor-alkali electrolysis cell having a cathode and the fibrous diaphragm juxtaposed thereto, in which the cathode and diaphragm are provided as a unit comprising a cathode screen and a fibrous asbestos diaphragm adhered thereto through the use of an organic cementing agent. The cathode has a roughened surface obtained by spray coating a powder metal on a ferrous metal substrate with the powder metal having a lower hydrogen overvoltage than said substrate, and having a larger surface area than the area of said substrate.

The invention also provides a process for manufacturing the chlor-alkali electrolysis cell containing the cathode and diaphragm unit of this invention. In the method form of the invention, the improvement comprises spray coating a ferrous metal substrate with a powder metal having a lower hydrogen overvoltage than said substrate to form a cathode with the cathode surface having a larger surface area than the surface area of the substrate, and vacuum depositing fibers onto a spray-coated surface of the cathode to form a fibrous diaphragm securely adhered thereto, said fibrous diaphragm comprising asbestos and from about 10 to about 30 percent based on the weight of asbestos of an organic cementing agent.

DESCRIPTION OF THE PREFERRED EMBODIMENTS

As hereinbefore noted, the present invention contemplates the spraying of a powder metal onto a conventional cathode deployed in an electrolytic chlor-alkali cell. The powder metal is either flame sprayed or plasma sprayed onto the cathode.

With more particularity, the present invention contemplates the spraying of a powder metal onto a ferrous metal cathode utilized in an electrolytic chlor-alkali cell. The chlor-alkali cell can be either a monopolar or bipolar cell. Furthermore, the cell employs the special diaphragm more fully defined hereinafter.

As noted, the powder metal is either flame sprayed onto the cathode or plasma sprayed onto the cathode. The spraying of the metal onto the cathode surface provides a high degree of bonding while increasing the surface area of the cathode. Furthermore, by spraying the coating onto the surface, the resulting roughened surface provides the proper conditions for efficient hydrogen bubble release. This is to be contrasted with the prior art noted hereinbefore which did not enhance the efficiency of the hydrogen bubble release.

Flame spraying and plasma spraying techniques, per se, are known. Flame spraying generally comprises spraying and fusing a powder metal onto a metallic surface with a flame. Such flames are generated with a torch or similar apparatus. Such apparatus and techniques are more comprehensively discussed in U.S. Pat. Nos. 3,238,060; 2,786,779 and 3,220,068.

Plasma spraying generally comprises the utilization of an electric arc discharge through which a plasma gas is passed. As the gas passes the electric arc the gas is ionized. Thus, there is achieved a plasma or ionized gas. There is admixed with the plasma of ionized gas, a powder metal suspended in a carrier gas therefor. Usually, a plasma spray gun is utilized for the plasma spray coating. Such guns are known. One such gun is depicted in U.S. Pat. No. 3,630,770.

In practicing the present invention, it is preferred to plasma spray coat the cathode. Plasma spraying provides a higher temperature and a more non-oxidizing atmosphere than flame spraying and results in a greater degree of bonding than flame spraying. In fact, plasma spraying provides a substantially non-oxidizing atmosphere. The gases employed in plasma spraying are nitrogen and hydrogen, wherein hydrogen gas is ionized and the powder metal is suspended in the nitrogen.

The powder metals which can effectively be employed herein are those which have a lower hydrogen overvoltage than the ferrous metal used in manufacturing the cathode. Representative of the metals which can be used herein include, for example, cobalt, nickel, platinum, molybdenum, tungsten, manganese, iron, tantalum, niobium and mixtures thereof. In addition, alloys of these metals can be used. Also, metallic compounds such as carbides, nitrides and the like can be used such as tungsten carbide, iron nitride and the like. The pure metals can be used alone or can be admixed with the alloys and the compounds. Also, the alloys and the metallic compounds can be used alone. The only criteria attached to the metal are that it be a powder capable of being sprayed and having a lower hydrogen overvoltage than the cathode material. In the practice of the present invention, the preferred powder metal is nickel.

The metal is sprayed onto the cathode to a thickness of about 0.001 to about 0.006 inches. Preferably, the metal is deposited to a thickness of from about 0.002 to about 0.005 inches. By spraying the metal powder onto the cathode surface, the surface area is increased due to the uneveness of the sprayed particles and the inherent surface porosity of the coating.

In accordance with the present invention, diaphragms for electrolytic cells have the fibers thereof cemented to each other, and deposited on the cathode screen with a fluorohydrocarbon polymer or other cementing agent.

As is known to those skilled in the art, asbestos diaphragms are generally prepared by depositing a fibrous slurry of asbestos onto a cathode support. Usually, the slurry is vacuum deposited to densify and compact the slurry. Such methods of preparing diaphragms, as noted, are well known.

Because of the hydrophobic nature of the thermoplastic cementing agent, as well as the hydrophilic properties of the asbestos fibers upon bonding, it is preferred to include within the internal structure of matrix of the fibers, per se, a surface active agent. Surface active agents aid in dispersion of the hydrophobic cementing agent in the slurry. Suitable surfactants include both nonionic and anionic surfactants.

Useful nonionic surfactants include the oxyalkylene condensates of ethylene diamine, such as the ethylene oxidepropylene oxide block copolymers prepared by the sequential addition thereof to ethylene diamine, and as described in U.S. Pat. No. 2,979,528.

Other useful organic surface active agents include polyoxyethylene alkylphenols, polyoxyethylene alcohols, polyoxyethylene esters of fatty acids, polyoxyethylene mercaptans, polyoxyethylene alkylamines, polyoxyethylene alkylamides, polyol surfactants and the like.

Preferred surface active agents are the perfluorinated fatty acids or alcohols or sulfonate-based surfactants.

The cementing agents hereof, and as previously noted are, preferably, fluorohydrocarbons. Although any cementing agent that is capable of resisting chemical attack in an electrolytic cell can be utilized, the fluorohydrocarbon polymers have been found to be eminently useful. The cementing agent or cement is employed in an amount ranging from about 10 to 30 percent, by weight thereof, based on the weight of the asbestos fiber. Preferably, the cement is employed in an amount ranging from about 15 to 25 percent, by weight thereof, based on the weight of the asbestos fiber.

The cementing agent can be employed as a dry powder or as a solution thereof in a suitable non-reactive solvent. Also, fibers of the cementing agent can be utilized. It has been found that when fibers of the cementing agent are admixed with an asbestos slurry, the fibers remain in the slurry as discrete particles thereof.

When employed as a powder, the agent is admixed with the fiber slurry prior to its deposition on the cathode screen.

Where deployed as a solution, one useful method for applying the solution is achieved by first depositing the diaphragm on the cathode screen and thereafter, contacting the deposited fibrous diaphragm with the cement solution.

Useful fluorohydrocarbon polymer cementing agents contemplated for use in the present invention include, for example, fluorinated ethylene and propylene copolymers, polyethylenetetrafluoroethylene, polyethylenechlorotrifluoroethylene, polychlorotrifluoroethylene, polyvinylidene fluoride, copolymers of chlorotrifluoroethylene, and the like, as well as mixtures thereof.

Suitable solvents for deploying the fluorohydrocarbon as a solution include nitrobenzene, hexachlorobenzene, and the like. Generally, a one to ten percent, by weight, solution is utilized.

In practicing the present invention, it should be noted it is also preferred that where used, the thermoplastic fibers have a fiber diameter of from about 0.05 to 40 microns.

The diaphragms hereof are prepared by depositing the slurry, with the cementing agent in admixture therewith, on a cathode screen. In this way, the asbestos fibers are cemented to the screen without covering the screen surface as is necessary when asbestos is used without a cementing agent. This construction provides a better cathode surface for hydrogen generation.

After the fibers are deposited on the screen, the so-prepared diaphragm is, then, washed with water. It has been found that washing the diaphragm removes electrolytes therefrom. Electrolytes are ordinarily present in the slurry from which the diaphragms are prepared. This is especially true if the asbestos diaphragms with cementing agents are formed from substantially asbestos slurries.

Furthermore, it has been found that the failure to wash the diaphragm has a deleterious effect thereupon. The electrolyte salts, if not washed out, crystallize upon heat treatment. This, in turn, produces a diaphragm with an excessively large pore size. Thus, the performance of such diaphragms is well below what it should be thereby negating the utility thereof. By washing the diaphragms after fiber deposition on the screen, the electrolyte salts are removed. In washing the diaphragm, by any convenient mode, distilled water is utilized.

After the diaphragm is washed with the water, it is, then, heat treated to bond the fibers to each other. Heat treating is carried out at a temperature ranging from about 100° C. to about 300° C. for a period of from about one-half to about one hour.

For a more complete understanding of the present invention, reference is made to the following examples thereof. In the examples, which are illustrative rather than limitative of the invention, all parts are by weight, absent indications to the contrary.

EXAMPLE 1

To a conventional two percent, by weight, asbestos slurry containing 0.5 percent by weight, based on the weight of the asbestos, of FLUORAD FC-126 fluorohydrocarbon surfactant, was added twenty percent, by weight, based on the weight of the asbestos, of polyethylenechlorotrifluoroethylene powder. The powder was mixed with the slurry to render the slurry uniform.

The slurry was then deposited onto a mild steel cathode screen by drawing the slurry through the cathode screen under vacuum in accordance with conventional techniques.

Thereafter, the diaphragm was washed with distilled water by vacuum suction of the water through the diaphragm. The diaphragm was then dried in an oven at about 100° C., to remove excess water, for eight hours. Thereafter, the diaphragm was heat treated to bond the asbestos fibers, at 260° C. for one hour.

The diaphragm was then mounted in a test chlor-alkali cell and brine electrolysis was carried out therewithin. The performance of the unit is given in the table below.

EXAMPLE 2

A mild steel cathode was plasma spray coated on one side with a powder nickel to a thickness of about 0.002 inches. The powder nickel employed was sold commercially under the name "METCO Nickel Powder 56 N-FS." A polymer impregnated asbestos diaphragm was deposited on the nickel coating of the cathode in accordance with the procedure of Example I. The diaphragm was then mounted in a test chlor-alkali cell and brine electrolysis was carried out therein. The performance of the unit is also given in the table below.

EXAMPLE 3

A procedure of Example 2 was repeated except that the mild steel cathode was plasma spray coated with nickel on both sides thereof. The diaphragm was then mounted in a test chlor-alkali cell and brine electrolysis was carried out therewithin. The performance of this unit is also given in the table below.

Table

| Days of Operation | Example 1 | | Example 2 | | Example 3 | |
|---|---|---|---|---|---|---|
| | Cell Volts | Cathode Volts | Cell Volts | Cathode Volts | Cell Volts | Cathode Volts |
| 24 | 3.16 | 1.37 | 3.08 | 1.23 | 2.99 | 1.19 |
| 28 | 3.16 | 1.36 | 3.22 | 1.27 | 3.01 | 1.20 |
| 32 | 3.06 | 1.33 | 3.01 | 1.27 | 3.00 | 1.21 |
| 36 | 3.31 | 1.39 | 3.05 | 1.29 | 2.98 | 1.21 |
| 38 | 3.35 | 1.39 | 3.07 | 1.28 | 3.00 | 1.21 |

In the table above, the cathode volts were measured against a saturated calomel electrode to obtain the potential of the cathode. As is seen from the data, the cells of Examples 2 and 3 operated with good voltage efficiency both through the diaphragm and at the cathode, and this is particularly true of the preferred Example 3. However, the cells of Example 1, a comparison example, were inferior. In the examples tested, the asbestos diaphragms were made with the usual thickness used with asbestos diaphragms.

The results of both the cell and cathode voltage are also better than with conventional asbestos diaphragms at the same thickness. However, because of increased strength, the diaphragms made according to the invention may be made thinner, and it is expected that with thinner diaphragms further increased cell energy efficiency will be provided.

The embodiments of the invention in which an exclusive property or privilege is claimed are defined as follows:

1. In a method for manufacturing a chlor-alkali electrolysis cell having a cathode and a fibrous diaphragm justaposed thereto, the improvement comprising spray coating a ferrous metal substrate with a powder metal selected from the group consisting of nickel, cobalt, tungstun carbide, and mixtures thereof, to form the cathode with the cathode surface having a larger true surface area than the geometric surface area of the substrate, and vacuum depositing a slurry containing asbestos fibers and an organic cementing agent onto a spray coated surface of the cathode to form a fibrous diaphragm securely adhered thereto, said fibrous diaphragm comprising asbestos and from about 10 to about 30 percent based on the weight of asbestos of the organic cementing agent.

2. The method as defined in claim 1, wherein the cementing agent is a fluorohydrocarbon polymer.

3. The method as defined in claim 2, wherein the cementing agent is present in the diaphragm in an amount of from about 15 to about 25 percent based on the weight of the asbestos.

4. The method as defined in claim 1, wherein the substrate is spray coated by flame spraying the powder metal onto the substrate.

5. The method as defined in claim 1, wherein the substrate is spray coated by plasma spraying the powder metal onto the substrate.

6. The method as defined in claim 1, wherein the powder metal is nickel.

7. The method as defined in claim 1, wherein the slurry of asbestos fibers and organic cementing agent also contains a surfactant.

8. In a chlor-alkali electrolysis cell having a cathode and a fibrous diaphragm juxtaposed thereto, a cathode and diaphragm unit comprising a cathode screen having a ferrous metal substrate, and a surface formed by spray coating a powder metal on said substrate, said powder metal selected from the group consisting of nickel, cobalt, tungston carbide, and mixtures thereof, and having a larger true surface area than the geometric surface area of the substrate, and a fibrous diaphragm comprising asbestos fibers and from about 10 to about 30 percent, based on the weight of asbestos, of an organic cementing agent in substantially uniform admixture with the fibers, said fibrous diaphragm being formed on the cathode screen with organic cementing agent present whereby cementing agent is disposed between the fibers and cathode screen.

9. The cell as defined in claim 8, wherein the cementing agent is a fluorohydrocarbon polymer.

10. The cell as defined in claim 9, wherein the cementing agent is present in the diaphragm in an amount of from about 15 to about 25 percent based on the weight of the asbestos.

11. The cell as defined in claim 8, wherein the substrate is spray coated by flame spraying the power metal onto the substrate.

12. The cell as defined in claim 8, wherein the substrate is spray coated by plasma spraying the powder metal onto the substrate.

13. The cell as defined in claim 8, wherein the powder metal is nickel.

14. The cell as defined in claim 8, wherein the coating has a thickness of from about 0.001 to about 0.006 inches.

* * * * *